US005640173A

United States Patent [19]

Prince et al.

[11] Patent Number: 5,640,173

[45] Date of Patent: Jun. 17, 1997

[54] METHODS AND SYSTEMS FOR DETECTING AND CORRECTING DYNAMIC CROSSTALK EFFECTS APPEARING IN MOVING DISPLAY PATTERNS

[75] Inventors: Dennis W. Prince, Banks; Benjamin R. Clifton, Oregon City, both of Oreg.; William J. Leybold, Vancover, Wash.

[73] Assignee: In Focus Systems, Inc., Wilsonville, Oreg.

[21] Appl. No.: 407,951

[22] Filed: Mar. 21, 1995

[51] Int. Cl.[6] ..... G09G 3/36

[52] U.S. Cl. ..... 345/58; 345/98

[58] Field of Search ..... 345/55, 58, 98, 345/100

[56] References Cited

U.S. PATENT DOCUMENTS

| | | | |
|---|---|---|---|
| 5,262,881 | 11/1993 | Kuwata et al. | 359/55 |
| 5,307,084 | 4/1994 | Yamaguchi et al. | 345/58 |
| 5,420,604 | 5/1995 | Scheffer et al. | 345/100 |
| 5,434,588 | 7/1995 | Parker | 345/98 |
| 5,440,322 | 8/1995 | Prince et al. | 345/58 |
| 5,459,495 | 10/1995 | Schaeffer et al. | 345/147 |
| 5,473,338 | 12/1995 | Prince et al. | 345/58 |
| 5,543,945 | 8/1996 | Kimura et al. | 345/100 |

FOREIGN PATENT DOCUMENTS

| | | | |
|---|---|---|---|
| WO9429842 | 12/1994 | WIPO | G09G 3/36 |

OTHER PUBLICATIONS

B. Clifton, D. Prince, B. Leybold, T. J. Scheffer et al., "Optimum Row Functions and Algorithms for Active Addressing, " *SID 93 Digest of Technical Papers,* 89–92, vol. XXIV, 1993.

A. R. Conner and T. J. Scheffer, *Proceedings of 12th International Display Research Conference* (Japan Display '92), 69–72, 1992.

T. N. Ruckmongathan, "A Generalized Addressing Technique For RMS Responding Matrix LCDS," *1988 International Display Research Conference,* 80–85, 1988.

*Primary Examiner*—Wendy Garber
*Attorney, Agent, or Firm*—Stoel Rives LLP

[57] ABSTRACT

The invention identifies the cause of and solves so-called display pattern splicing in passive matrix displays implemented with Active Addressing™ techniques or other techniques that produce column signals having more than one magnitude. Splicing is an optical aberration that is manifested by a transient pixel rms voltage deviation from a current, frame-averaged value that occurs when one image changes to a new one. Active solutions to display pattern splicing apply a correction of some type to counteract the effects of the transient optical response. Preferred active solutions are premised on the observation that splicing is an effect common to all pixels on a column. One type of active solution includes different embodiments that entail determining the amplitude and character of the display pattern splice and introducing a compensating signal as a function of the amplitude and character of the splice to counteract it. One embodiment modifies the column signal values applied to the column electrodes, and another embodiment adds correction time intervals to a frame period to adjust the rms voltages of the column signals applied during the frame period.

19 Claims, 8 Drawing Sheets

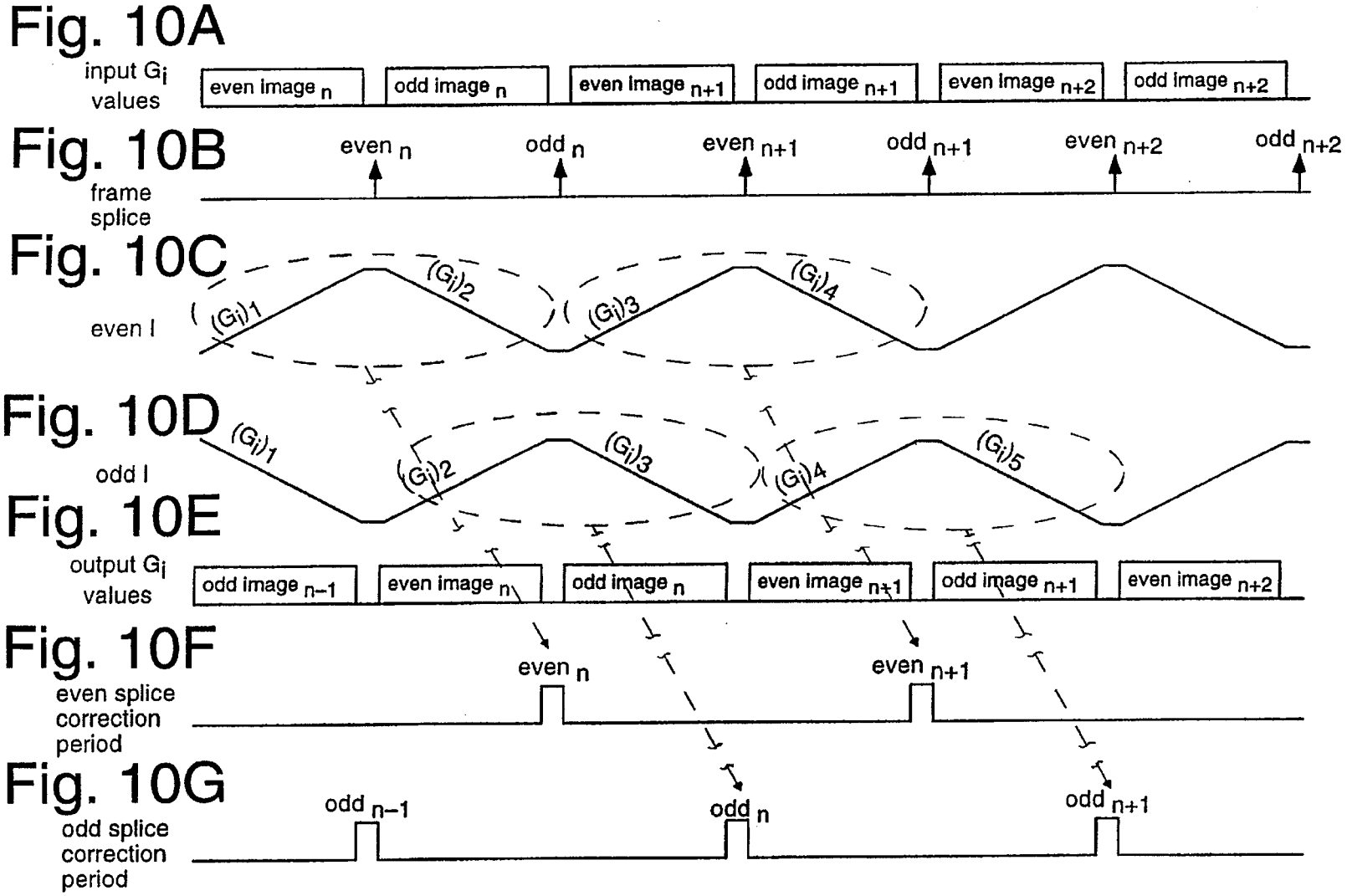
Fig. 10A
input $G_i$ values
even image n
odd image n
even image n+1
odd image n+1
even image n+2
odd image n+2
Fig. 10B
frame splice
even n
odd n
even n+1
odd n+1
even n+2
odd n+2
Fig. 10C
even I
$(G_i)_1$
$(G_i)_2$
$(G_i)_3$
$(G_i)_4$
Fig. 10D
odd I
$(G_i)_1$
$(G_i)_2$
$(G_i)_3$
$(G_i)_4$
$(G_i)_5$
Fig. 10E
output $G_i$ values
odd image n-1
even image n
odd image n
even image n+1
odd image n+1
even image n+2
Fig. 10F
even splice correction period
even n
even n+1
Fig. 10G
odd splice correction period
odd n-1
odd n
odd n+1

METHODS AND SYSTEMS FOR DETECTING AND CORRECTING DYNAMIC CROSSTALK EFFECTS APPEARING IN MOVING DISPLAY PATTERNS

TECHNICAL FIELD

The present invention relates to display pattern artifacts resulting from crosstalk effects and, in particular, to splicing effects appearing in moving display patterns developed on a passive matrix display addressed in accordance with a technique that produces multi-level column signals.

BACKGROUND OF THE INVENTION

U.S. patent application Ser. Nos. 07/678,736, filed Apr. 1, 1991, and 08/058,316, filed May 3, 1993, describe techniques for overcoming frame response effects in the display of video images on passive matrix liquid crystal display (PMLCD) screens. The breakthrough discovery enabling the display of images at video rates on PMLCDs is the so-called Active Addressing™ (AA) technique. This technique is implemented by applying row signals that select rows multiple times and distribute the selections over the frame period and by determining, at each addressing interval during the frame period, multi-level column signals having more than two levels from pixel input data representing the pattern to be displayed and the row signals causing selections. Thus, the row signals are independent of the pixel input data, but the column signals are not.

There is a dynamic artifact present in moving images on PMLCDs implemented with AA techniques or any other addressing technique that produces column signals having more than one magnitude. Such artifacts called "splicing" appear on a display screen as slight flashing or as streaking of a group of pixels aligned in the direction of the image vector, which typically is along the column direction. Splicing appears as flashing pixels for computer graphics images and as vertical streaking or "raining" for natural images. Splicing is only a dynamic problem and, therefore, does not occur when the image is static.

SUMMARY OF THE INVENTION

An object of the invention is to determine the cause of splicing in moving display patterns presented on a passive matrix display implemented with a technique that produces column signals having more than one magnitude.

Another object of the invention is to provide a passive matrix display that is capable of presenting moving video display patterns in the absence of splicing.

The present invention identifies the cause of and solves so-called display pattern splicing in passive matrix displays implemented, by way of example only, with AA techniques. The rms voltage of a pixel waveform developed in accordance with AA techniques is generally not constant when the average is taken over a time that is less than a frame period. A fast-responding liquid crystal material (i.e., a response time of about 50 milliseconds) is able to follow these fluctuations in rms voltage and thereby results in fluctuations in pixel transmission or brightness. When standard addressing is implemented, these fluctuations in brightness, known as "frame response," are quite severe and result in loss of display contrast and diminished overall brightness. The transmission fluctuations with pixel waveforms developed in accordance with AA techniques are much less severe and can be detected only with a fast-responding optical probe and recording device, such as an oscilloscope. Applicants use the term "mini-frame response" to refer to the pixel transmission fluctuations resulting from display addressing in accordance with AA techniques. The character of mini-frame response depends on the pixel voltage waveform, which depends on the pixel input data of the entire column. Mini-frame response is the cause of display pattern splicing.

Splicing is an optical aberration caused by a change in image information displayed by a pixel. Splicing is manifested by a transient pixel rms voltage deviation from the current, frame-averaged value that occurs when one image changes to a new one. A frame period of a pixel can be generally defined as the time between corresponding time intervals during which image data can change. In the preferred embodiments described below by way of example only, a frame period is defined by the time between time intervals corresponding to the first pixel in the first row of a matrix display. The optical response of a pixel has an average or a perceived brightness that ideally depends only on the frame-averaged rms voltage of the pixel waveforms. Display pattern splicing stems from a dynamic crosstalk effect that is caused by the presence of waveforms of different character addressing a pixel over adjacent frame periods, even when the frame-averaged rms voltages of the waveforms are the same. The degree of perceived display pattern flashing corresponds well to the amount of transient rms voltage deviation from the nominally correct frame-averaged value.

When the display pattern is static, the optical response of a pixel remains periodic at a rate such that a viewer perceives no flicker. When the display pattern changes, there can be an unintended transient in the optical responses of neighboring non-switching pixels. Applicants observed, for example, that moving a cursor across the display screen produced splicing in the form of a vertical gray bar that followed the path of cursor motion. The presence of the gray bar in the column direction suggested that the splice affected all pixels in the column.

The changing character of the pixel waveforms can cause a transitional pixel rms voltage deviation. The pixel rms voltage averaged over a time window of a duration preferably equal to that of the frame beginning at half of the old frame and ending at half of the new frame deviates from a nominally correct frame-averaged value as the pixel waveform transitions from the old display pattern to the new display pattern. The PMLCD responds to the transitional pixel rms voltage deviation by flashing either too bright or too dim during the transition, depending whether the net rms voltage deviation is greater or less than the nominal frame-averaged pixel rms voltage to which the pixel is to be addressed.

Applicants note that in PMLCDs implemented with standard addressing techniques, there is no splicing because the column voltage at any time is at only one of two levels, regardless of the data pattern.

Two general categories of solutions that reduce dynamic crosstalk in PMLCDs implemented with AA techniques include passive solutions and active solutions.

Passive solutions include certain display operation or configuration techniques that modify the AA method to minimize display pattern flashing or streaking. One type of passive solution entails increasing the display frame rate so that the transitional rms voltage deviation applied to the pixels during an image transition occurs over a shorter time window and thereby reduces the dynamic crosstalk effect. A second type of passive solution entails redistributing the time intervals of the row signals applied to the row electrodes to reduce the probability of large transitional rms deviations between frames of different display patterns.

Active solutions are ones in which a correction of some type is applied to counteract the effects of the transient optical response. Preferred active solutions are premised on the observation that splicing is an effect common to all pixels on a column. One preferred type of active solution entails determining the amplitude and character of the display pattern splice and introducing a compensating signal as a function of the amplitude and character of the splice to counteract it. Any one of several methods of determining the amplitude and character of the crosstalk can be used in implementing an active solution.

Additional objects and advantages of the present invention will be apparent from the following detailed description of preferred embodiments thereof, which proceeds with reference to the accompanying drawings.

BRIEF DESCRIPTION OF THE DRAWINGS

FIG. 10 comprised of FIGS. 10A, 10B, 10C, 10D, 10E, 10F and 10G, is a timing diagram showing the relationship of the processing steps carried out by the system of FIG. 9.

DETAILED DESCRIPTION OF PREFERRED EMBODIMENTS

Figure 1:
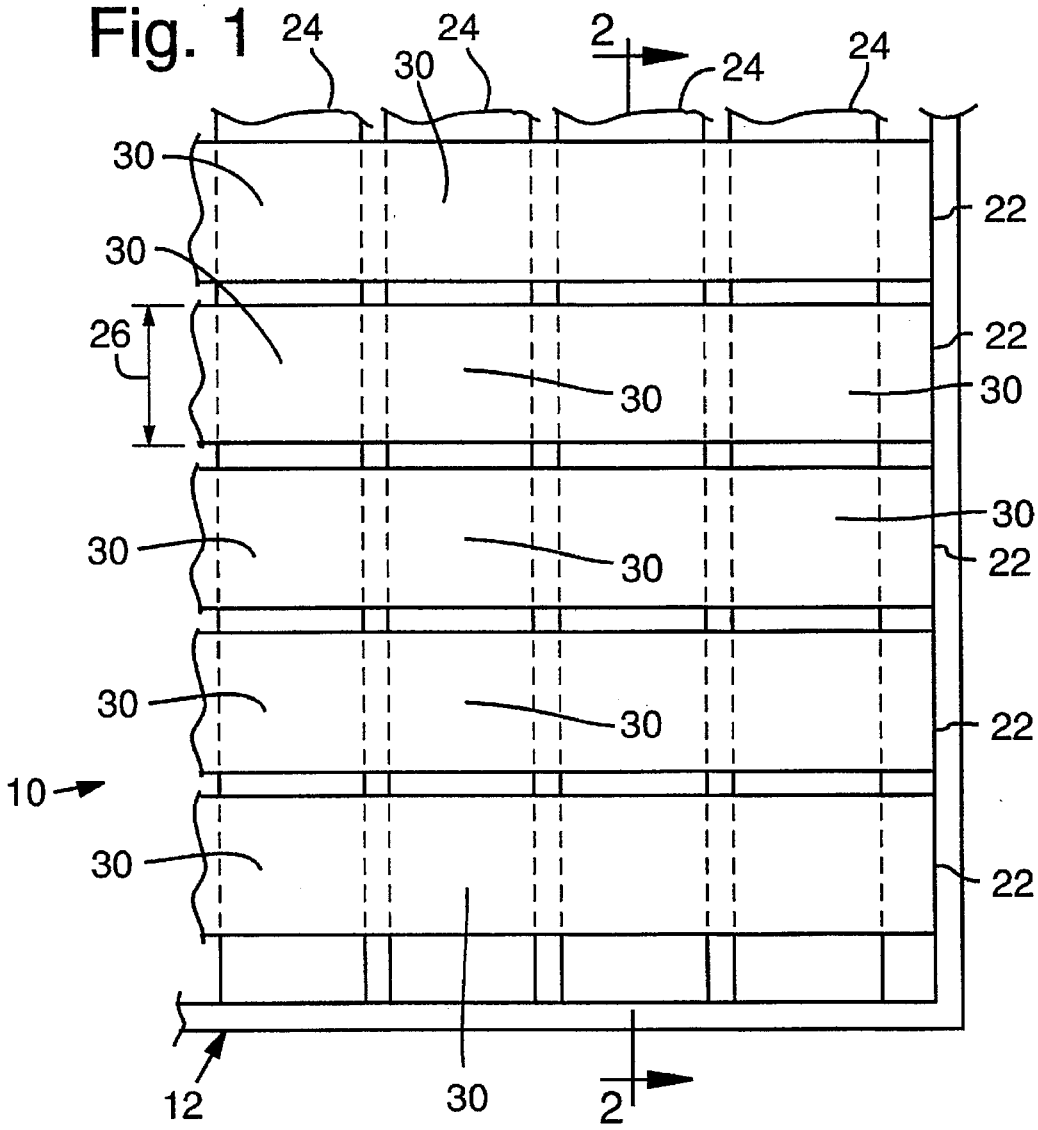
FIG. 1 is a fragmentary plan view of the row and column electrodes of a PMLCD matrix in a display system implemented with the splice correction techniques of the present invention.
Figure 2:
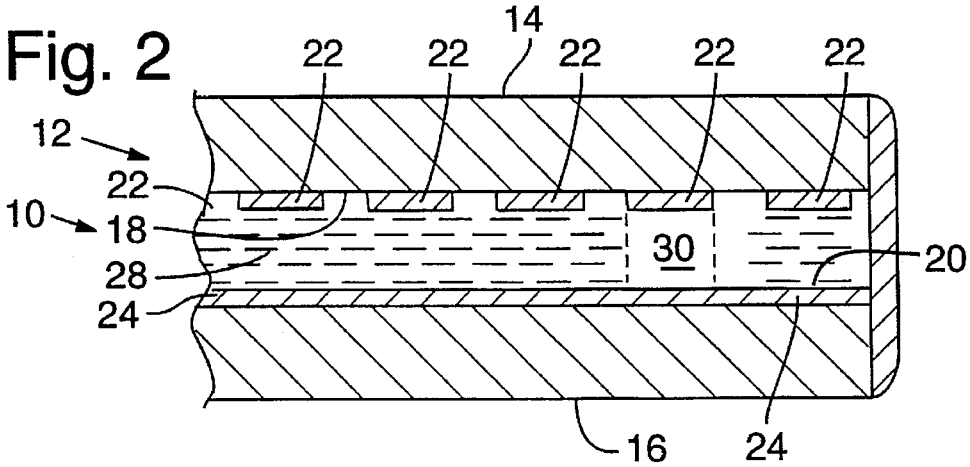
FIG. 2 is a fragmentary sectional view of the PMLCD matrix taken along lines 2—2 of FIG. 1.

FIGS. 1 and 2 are fragmentary views of a typical PMLCD system 10 of a type in which the present invention is implemented. System 10 comprises a display panel 12 that includes two glass plates 14 and 16 having on their respective inner surfaces 18 and 20 respective first and second sets of electrodes 22 and 24. The first and second sets of electrodes 22 and 24 will be referred to as row electrodes 22 and column electrodes 24, respectively, although this designation is arbitrary and either set of electrodes could be arranged as rows or columns. For a monochrome display, row electrodes 22 and column electrodes 24 are preferably oriented perpendicular to each other and are of equal width 26. An electro-optical material, such as a nematic liquid crystal 28 operated in a supertwist mode, is captured between plates 14 and 16. The overlapping areas of row electrodes 22 and column electrodes 24 define a matrix of display elements or pixels 30. Each row electrode 22 defines a row of pixels 30, and each column electrode 24 defines a column of pixels 30. Display system 10 includes a large number of such pixels 30, which together are capable of forming an arbitrary image.

Dynamic crosstalk effects are manifested on a display screen as a column line flash accompanying cursor motion on computer graphics images or as the appearance of "rain" in natural, moving images. Applicants have coined the term "dynamic crosstalk" because this type of image artifact does not appear in static display patterns. This is demonstrated by the optical response waveforms shown in FIGS. 3 and 4. FIGS. 3 and 4 show optical response waveforms measured by a photodetector placed in front of a single pixel of a PMLCD implemented with AA techniques.

Figure 3A:
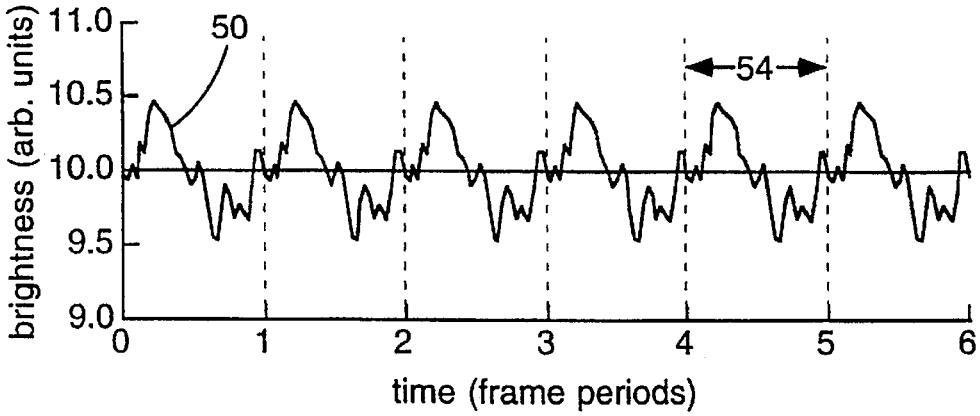
FIG. 3 comprised of FIGS. 3A and 3B, shows periodic pixel voltage and optical response waveforms including fluctuations known as "mini-frame response" for a pixel of a PMLCD addressed in accordance with an AA technique to display a static image.
Figure 3B:
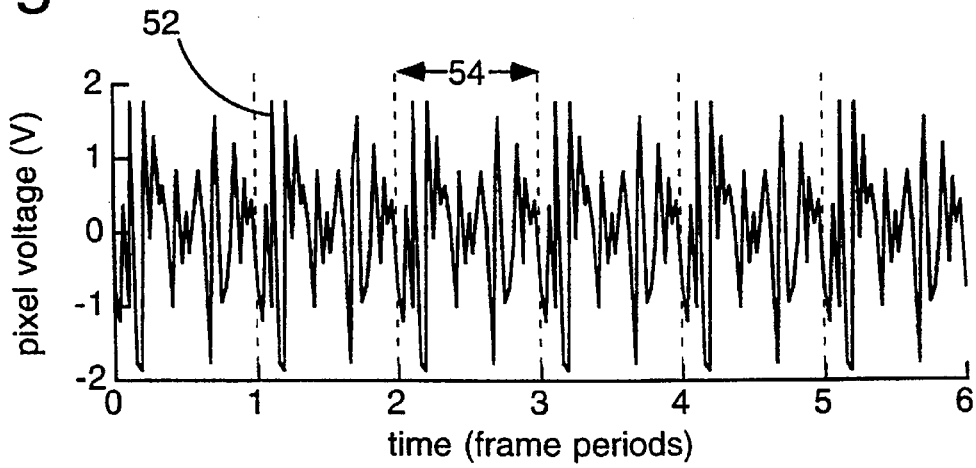

FIG. 3 shows an exemplary optical response waveform 50 (FIG. 3A) of periodic character and a corresponding voltage waveform 52 (FIG. 3B) across a pixel 30. Waveforms 50 and 52 include multiple frames each of a duration 54, and optical response waveform 50 has an average or a perceived flicker-free brightness that is determined by the frame-averaged rms voltage of pixel waveform 52. FIG. 3 corresponds to a static display pattern in the absence of dynamic crosstalk.

FIG. 4 shows an optical response waveform 56 (FIG. 4A) of a pixel voltage waveform 58 (FIG. 4B) of an unchanging pixel in a column of pixels whose display pattern changes. (An unchanging pixel is one that undergoes no nominal change in optical state even though the pattern displayed by the pixels in the column changes.) Pixel voltage waveform 58 includes multiple frames 60 of a first image display pattern changing to the multiple frames 62 of a second image display pattern. Waveform 56 includes multiple frames each of duration 54 and has a transitional change in the average optical response or "splice" 64 from the first pattern to the second pattern, followed by a gradual recovery interval 66 over several frames to the steady state average brightness 68 established before the pattern change occurred. The splice 64 and subsequent recovery interval 66 represent a short time during which the perceived pixel brightness is "wrong." Each pixel of the image display pattern has its own voltage wave shape that changes at the transition. Thus, the complete voltage waveform 58 represents the pixel voltage wave shapes of successive image display patterns. FIG. 4A illustrates that a change in display pattern results in dynamic crosstalk, which is manifested by a flash or streaking in the column direction.

The present invention identifies the cause of dynamic crosstalk effects by predicting the extent of display pattern splicing. The preferred embodiments of the invention entail examining the column voltage signals applied to their respective column electrodes defining the pixels. A column voltage signal developed in accordance with an AA technique depends on pixel input data values for pixels on the selected rows. This results in column signals having more than one magnitude.

During nominal operation, a PMLCD addressed in accordance with AA techniques has the following properties.

First, the rms voltage of a column signal during a given frame is the same for all the frames and is independent of the column data pattern. Thus, for example, an all-black image, an all-white image, and a checkerboard image would have column signals with the same rms voltage averaged over a frame period. Second, for an optimum selection ratio, the row signal rms voltages are also the same as the column signal rms voltages. This is not true, however, for the individual pixel voltages. Of course, for each pixel the rms voltage averaged over a frame period depends on the desired image state of the pixel. The preferred embodiments implementing active solutions to dynamic crosstalk rely on these properties and the occurrence of an rms voltage transient in the column voltage during the image transition to predict the degree of optical pattern splice exhibited by all pixels in that column.

Figure 4A:
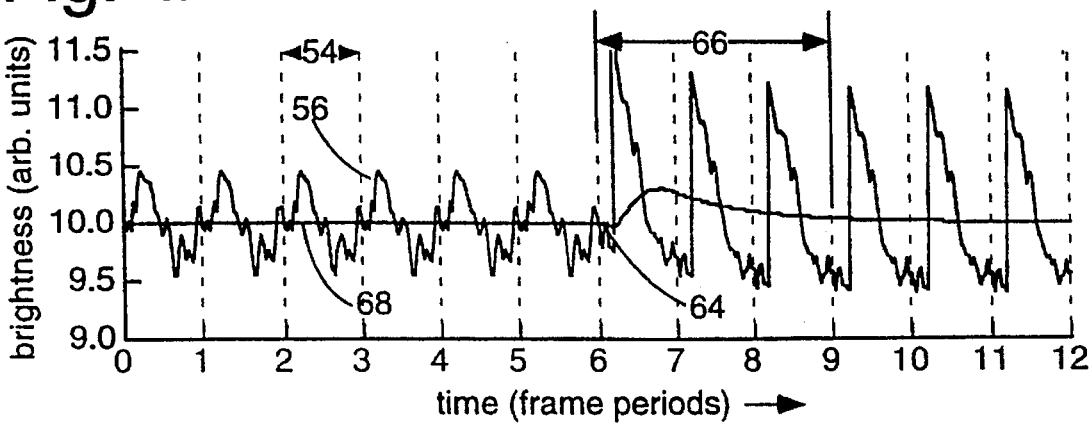
FIG. 4 comprised of FIGS. 4A, 4B, 4C, and 4D, shows optical response, pixel voltage, and pixel voltage process signal waveforms for an unchanging pixel in a column of pixels of a PMLCD addressed in accordance with an AA technique when the display pattern for that column of pixels changes to another display pattern.
Figure 4B:
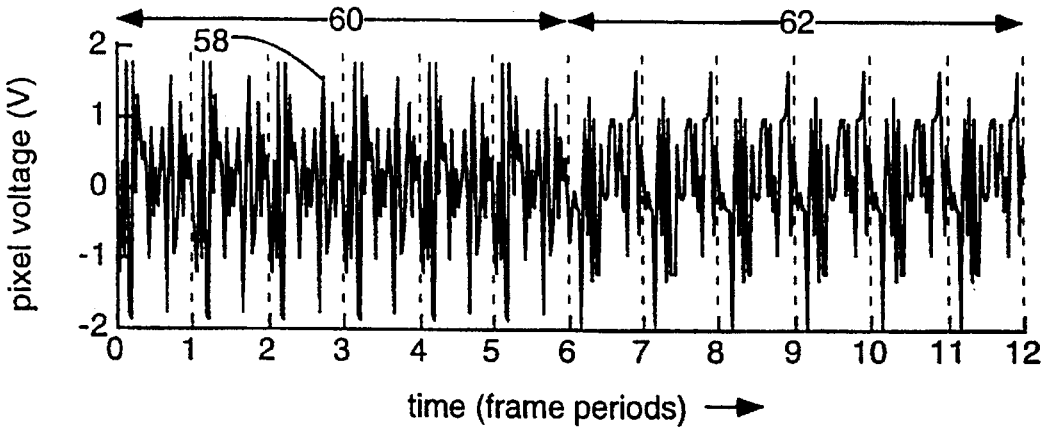
Figure 4C:
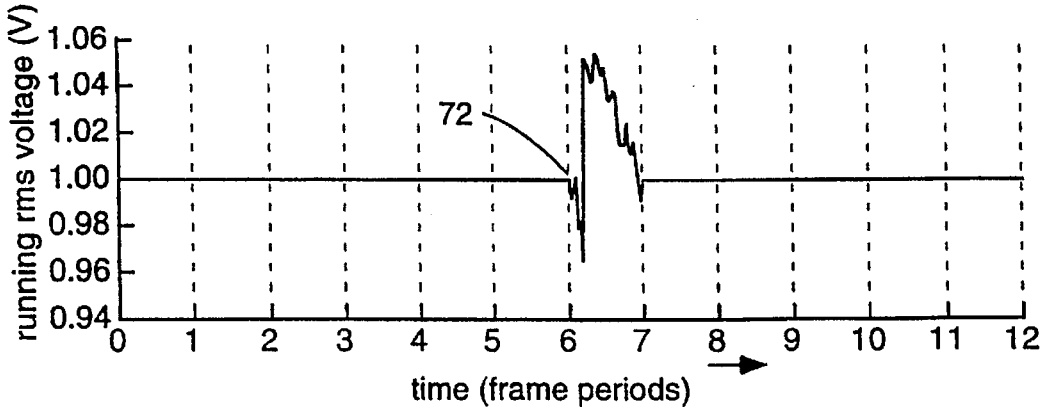
Figure 4D:
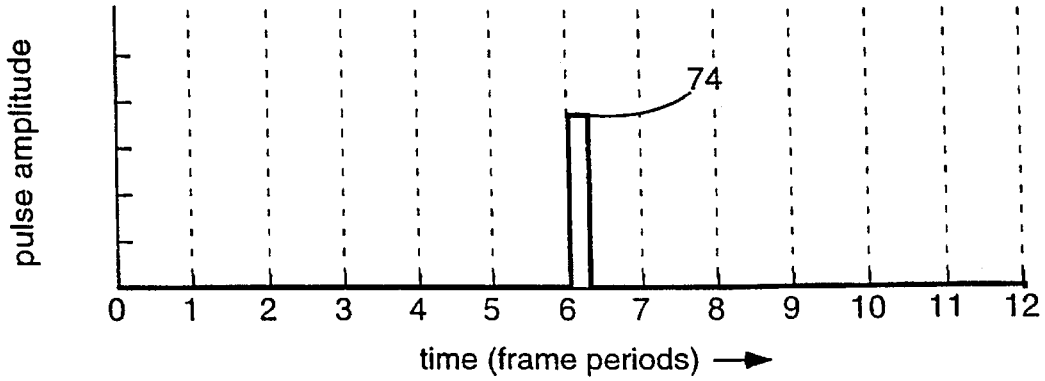

FIG. 4C shows the running rms values of the pixel voltages of waveform 58 FIG. 4B. Consistent with the properties set forth above, waveform 58 has running rms values, the definition of which follows, that do not change except at a transitional rms voltage deviation 72 that corresponds to splice 64 FIG. 4A. FIG. 4D shows a pulse whose height 74 is proportional to the average or rms of the transitional rms deviation 72 of the pixel voltage that produces the transient optical response or splice 64 in FIG. 4A. The magnitude and sign of pulse 74 indicates the magnitude and direction of splice 64. The foregoing relationships illustrated in FIG. 4 are useful in the implementations of the active solutions to image splicing.

Preferred active solutions to dynamic crosstalk are premised on the observation that splicing is an effect common to all pixels on a column. (A column is an electrode aligned in the direction of the image vector of a display implemented in accordance with an AA technique. An image vector includes all pixels whose values are used to compute the column signal.) One embodiment of an active solution corrects the column signals before they are applied to the column electrodes and entails the following steps that are performed on each column.

First, the rms voltage of the column signal is calculated over a time window of about one frame period in duration.

Second, the time window is successively phase-displaced to different positions representing various amounts of overlap of a first frame and a next succeeding second frame. Sets of running rms voltage averages are calculated by determining the rms voltage over a frame period while moving the time window across two frames of column signals.

Third, the rms of the running averages is calculated using a time interval-weighted gain correction filter to obtain a value that indicates the amplitude of the splice and to produce a correction signal.

Fourth, the magnitude of the column signal is scaled by an amount corresponding to the correction signal.

Figure 5:
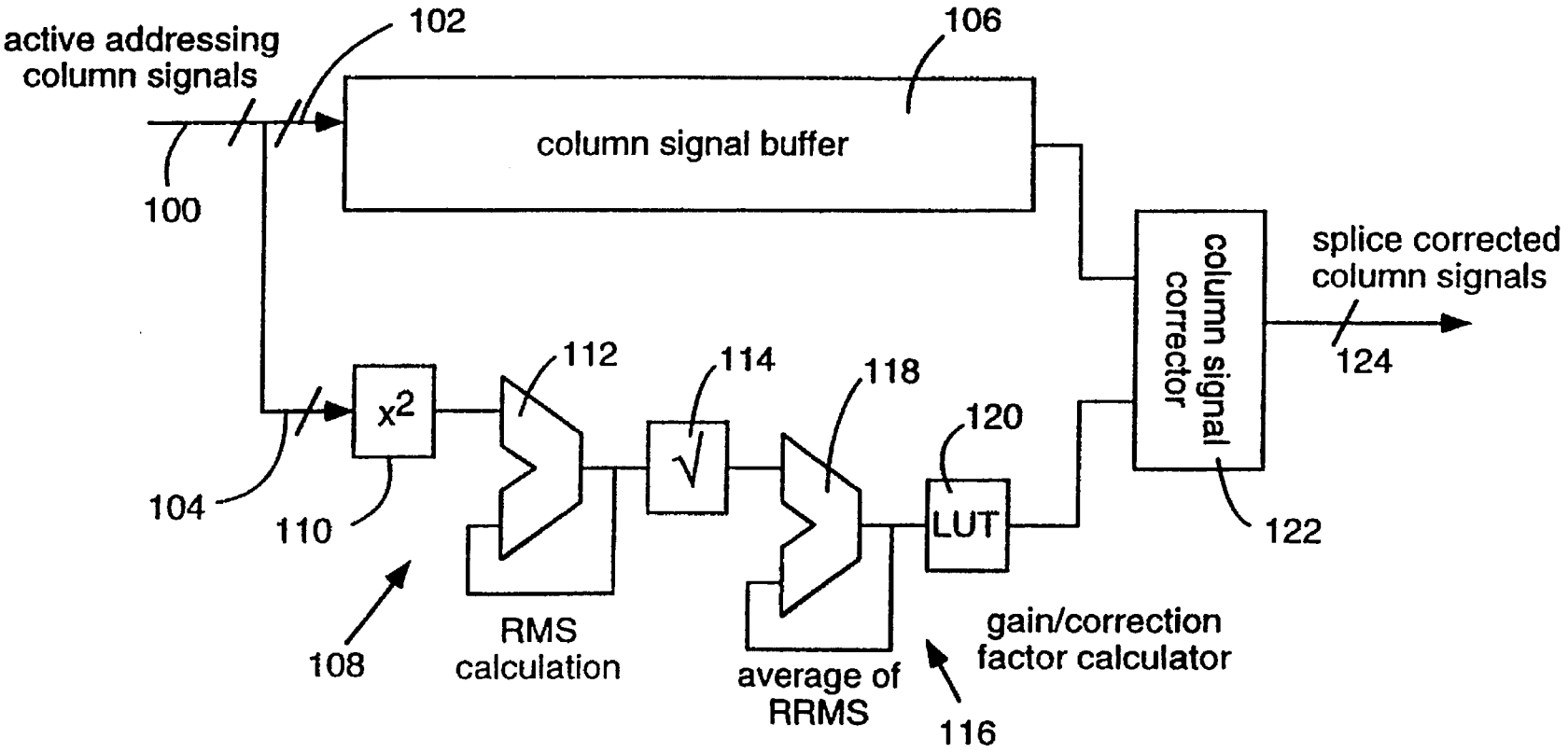
FIG. 5 is a block diagram of a general implementation of an active solution to dynamic crosstalk.
Figure 6A:
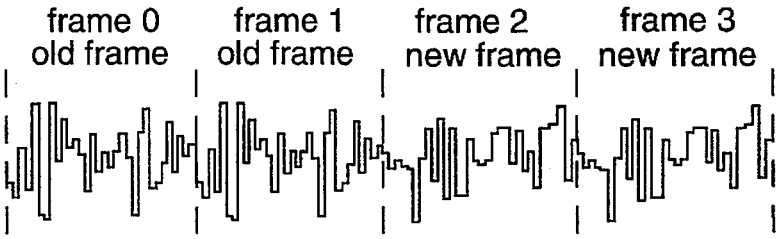
FIG. 6 comprised of FIGS. 6A, 6B, 6C, 6D, 6E, and 6F, shows the timing relationships associated with the signals developed by the implementation of FIG. 5.
Figure 6B:
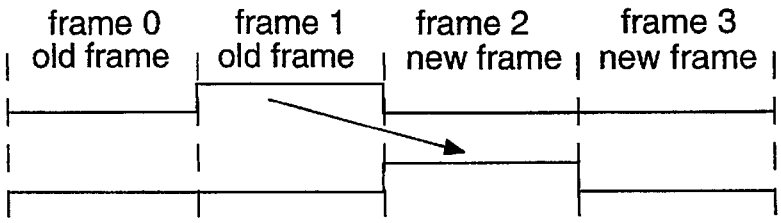
Figure 6C:
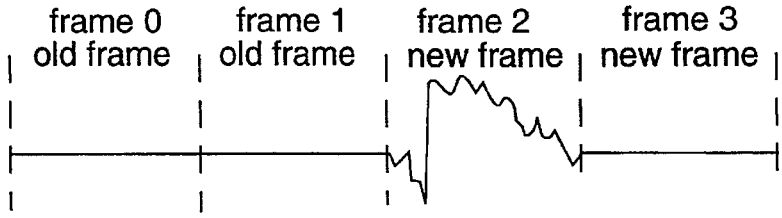

FIG. 5 is a block diagram that shows a general implementation of the active solution described above. FIGS. 6 and 7 show the timing relationships associated with the signals developed with the implementation of FIG. 5.

With reference to FIGS. 5, 6, and 7, column signals (FIG. 6A) computed in accordance with the AA techniques appear on a bus 100 and are separately parallel-processed in pipeline fashion along respective first and second paths 102 and 104. A column signal buffer 106 positioned along first path 102 receives all column signal voltage values for each addressing interval in an interval-by-interval serial sequence and functions as a delay register for them as the computations for display pattern splice error reduction are carried out in a corresponding serial sequence along second path 104. Signal buffer 106 includes a number of storage sites sufficient to hold column signal values of each column signal of an entire frame period. The column signal voltage values are applied to a running sum generator 108 of rms voltages that includes a squaring circuit 110, an accumulator 112, and a square root circuit 114.

An exemplary display system includes 256 time intervals per frame, 640 columns, and 256 time intervals in the time window. FIG. 7 is a diagram showing the relationship of the time window to the column signal voltage values $G_1$, $G_2$, . . . , $G_{256}$ of a frame 1 and the column signal voltage values $G_{257}$, $G_{258}$, . . . , $G_{512}$ of a subsequent frame 2 for a single column signal. (The column signal voltage values for each column signal are referred to generally as "$G_i$".) The splice point appears at the transition between frame 1 and frame 2 (FIG. 6A). The 256-addressing interval time window at its start position spans $G_1$–$G_{256}$ of frame 1 and at its end position spans $G_{257}$–$G_{512}$ of frame 2 (FIG. 6B); therefore, as the $G_i$ shift through running sum generator 108, the time window computes 257 running rms values by effectively moving or "sliding" across the frame 1 to frame 2 splice transition from the start position to the end position (FIG. 6B). For each column signal, these 257 rms computations are carried out by squaring circuit 110, accumulator 112, and square root circuit 114 of running sum generator 108 (FIG. 6C). The signal appearing at the output of square root circuit 114 is the transitional rms deviation. Thus, the duration of the time window is defined by the number of $G_i$ in any set of the running sums, and the time window effectively "slides" by the concurrent serial shifting out of $G_i$ of frame 1 time intervals of increasing order and shifting in of $G_i$ of frame 2 time intervals of increasing order (FIG. 6B).

The following expressions for $RRMS_1$, $RRMS_{128}$, and $RRMS_{512}$ represent, respectively, the first, center, and last running sum rms values:

$$RRMS_1 = \frac{1}{\sqrt{256}} \sqrt{G_1^2 + G_2^2 + \ldots + G_{256}^2} \tag{1}$$

$$RRMS_{128} = \frac{1}{\sqrt{256}} \sqrt{G_{128}^2 + G_{129}^2 + \ldots + G_{383}^2} \tag{2}$$

$$RRMS_{257} = \frac{1}{\sqrt{256}} \sqrt{G_{257}^2 + G_{258}^2 + \ldots + G_{512}^2} \tag{3}$$

Figure 6D:
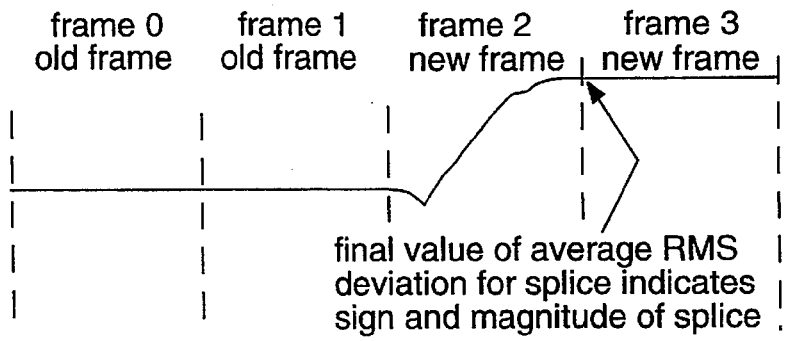
Figure 6E:
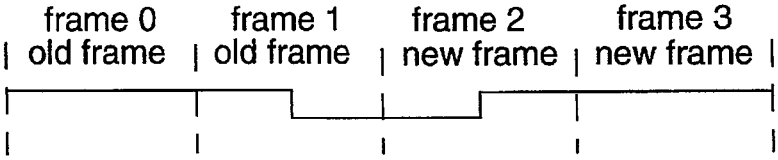
Figure 7:
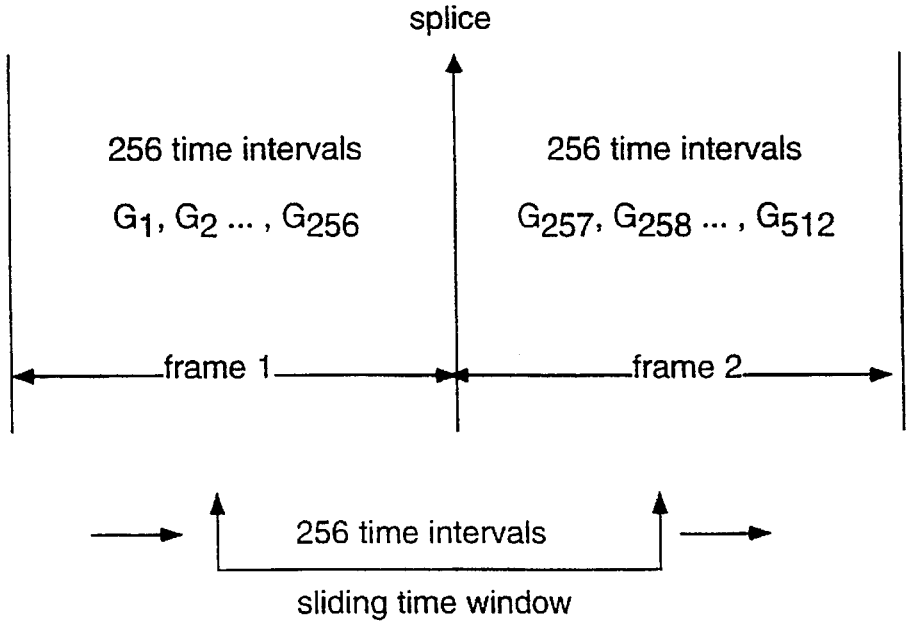
FIG. 7 is a diagram showing the relationship of the rms window to the column signal voltage values of two consecutive frames for the implementation relating to FIGS. 5 and 6.

An error-determining generator 116 that includes an accumulator 118 and a gain/correction factor calculator look-up table (LUT) 120 determines the splice error by computing the rms value of the 257 running sum rms values previously computed by running sum generator 118 (FIG. 6D). It is expressed as:

$$RMS(RRMS) = \frac{1}{\sqrt{256}} \sqrt{\frac{\sum_{i=1}^{257} RRMS_i^2}{257}} . \tag{4}$$

This quantity represents the average of the transitional rms deviation for a single column signal.

Figure 6F:
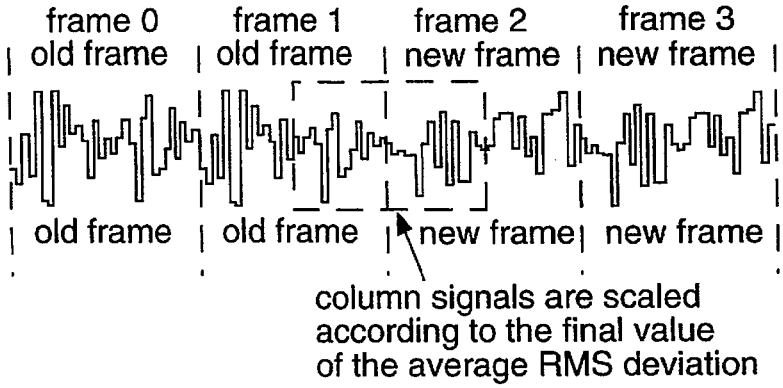

The average transitional rms deviation value is applied as an address to LUT 120, which is preprogrammed to store gain correction values corresponding to splice conditions of different magnitudes and signs. The gain correction factor appearing at the output of LUT 120 (FIG. 6E) is applied in addressing interval synchronism with the column signal values appearing at the output of buffer 106 to inputs of a column signal corrector programmable amplifier 122, on whose output 124 appear splice-corrected column signals for application to their respective column electrodes (FIG. 6F).

The gain correction shown in (FIG. 6F) is a linear scaling of the average transitional rms deviation to a gain for each of the column signals applied during the last half of frame 1 and the first half of frame 2. Programmable amplifier 122 adjusts for each column signal a column signal voltage value for each time interval by this gain correction factor. This is accomplished on the fly without a need for introducing additional time intervals at the transition between frames.

The width of the time window (i.e., the number of $G_i$ constituting a running sum) and the degree of overlap of the second frame can be selected to optimize the splice error determination process.

Figure 8:
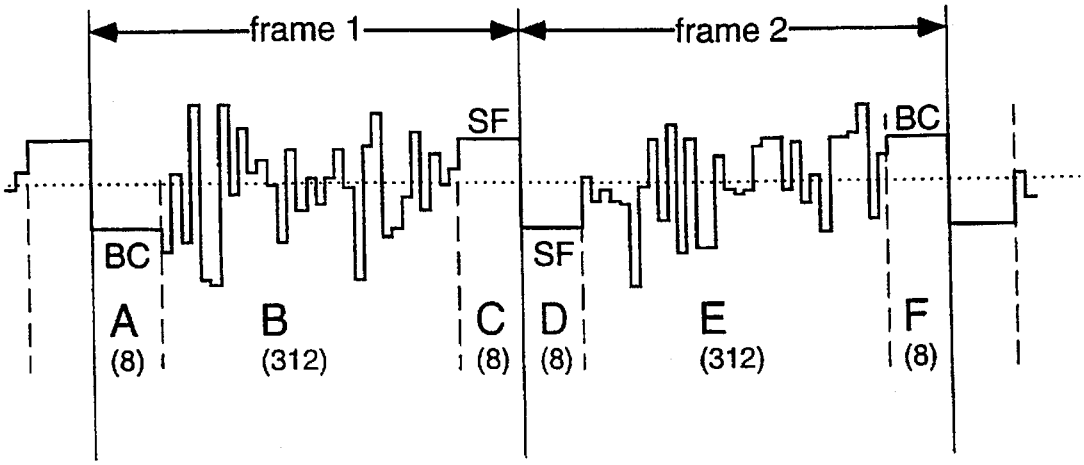
FIG. 8 is a diagram showing several image frame to illustrate the temporal relationship of the time intervals defined in accordance with a splice correction technique using additional time intervals at the frame boundary.
Figure 9:
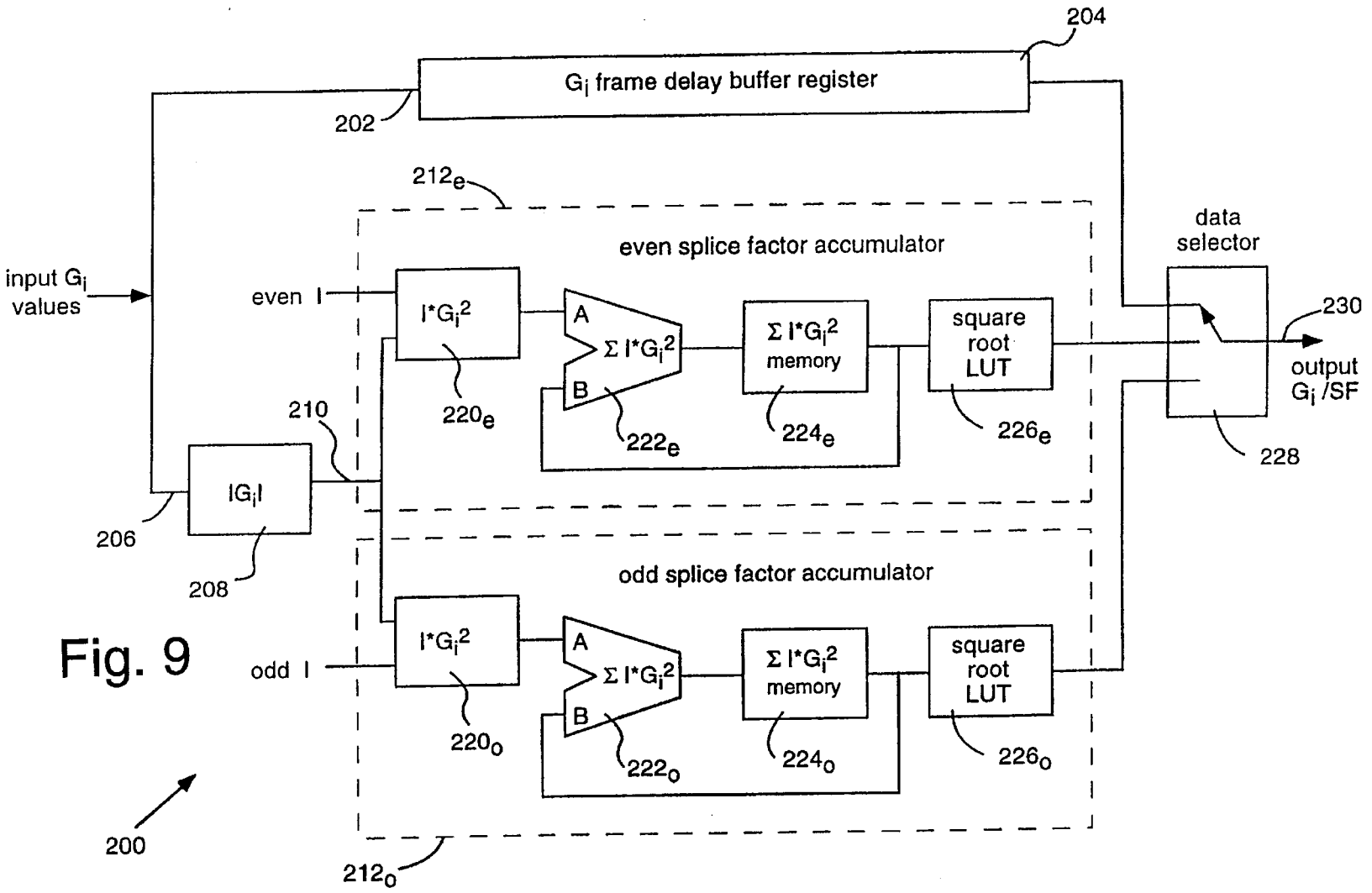
FIG. 9 is a block diagram of a system for implementing a splice correction technique using additional time intervals at the frame boundary.

FIGS. 8, 9, and 10 are respective signal waveform, block, and signal processing timing diagrams that relate to a preferred practicable implementation of the invention. This implementation adds an empirically derived number of 16 splice correction time intervals at the frame boundary, instead of changing the gain as was described with reference to FIGS. 5–7. The following is a description of the technique for calculating the signal voltages applied during these 16 splice correction time intervals. The parameters set out below are appropriate for carrying out the technique for a seven lines-at-a-time multiple line active addressing (MLAA) type display system, such as that described in B. Clifton, D. Prince, B. Leybold, T. J. Scheffer et al., "Optimum Row Functions and Algorithms for Active Addressing," *SID* 93 *DIGEST of Technical Papers,* 89–92, Vol. XXIV, 1993.

With reference to FIG. 8, each of the successive frames of a column signal waveform has 328 total time intervals and is divided into subframe intervals. For the exemplary frames 1 and 2, the subframe intervals are identified by the letters A, B, and C for frame 1 and D, E, and F for frame 2. The B and E subframe intervals represent the times when the normal row addressing waveforms are applied to the row electrodes of the display; they are set to zero during the other subframe intervals. Each of the B and E subframe intervals has 312 time intervals that include contributions from the column signal correlation sums (sometimes referred to as "scores") computed as described in B. Clifton, D. Prince, B. Leybold, T. J. Scheffer et al., "Optimum Row Functions and Algorithms for Active Addressing," *SID* 93 *DIGEST of Technical Papers,* 89–92, Vol. XXIV, 1993 and a pulse height modulation (PHM) gray scale correction factor computed as described in A. R. Conner and T. J. Scheffer, *Proceedings of* 12*th International Display Research* Conference (Japan Display '92), 69–72, 1992. Subframe interval A located at the start of frame 1 and subframe interval F located at the end of frame 2 each represent, for eight time intervals, a base correction "BC" or no-correction value that is in effect when no splice correction is required. The base correction value BC is selected such that |A|=|F|=BC. Because the A and F values are of opposite sign, there is no residual DC voltage.

The C and D subframe intervals located at the transition between frames 1 and 2 each represent, for eight time intervals, a splice factor "SF" value that is computed in accordance with the algorithm and the implementation thereof described below. The computed splice factor SF is applied during the time intervals of subframe intervals C and D to correct for the splice "SPLICE 1", and the SF value is expressed as |C|=|D|=SF. The C and D values are of opposite polarity to eliminate a DC voltage resulting from the splice correction. The BC and SF values are related in that the former provides a nominal baseline rms voltage to which the SF can be added or from which the SF can be subtracted. When there is no splice correction, the algorithm provides equal BC and SF values.

The BC value is selected to equal a quantity $F_{bar}$, which over a frame is the rms value of the column signals or the rms value of the row signals (because for the AA technique they are equal quantities) when the 16 correction time intervals (i.e., A and C for frame 1) are removed. The following is a summary derivation of the algorithm for computing the SF in accordance with this embodiment.

Each of the frames in the embodiment described above has 328 time intervals; therefore, the following expressions for $RMS_1$ and $RRMS_{329}$ represent, respectively, the first and last running sum rms values for frames 1 and 2:

$$RRMS_1 = \frac{1}{\sqrt{328}} \sqrt{G_1^2 + G_2^2 + \ldots + G_{328}^2} \tag{5}$$

$$RRMS_{329} = \frac{1}{\sqrt{328}} \sqrt{G_{329}^2 + G_{330}^2 + \ldots + G_{656}^2} \tag{6}$$

The rms value of the 329 running sum rms values can be represented as the summation:

$$RMS(RRMS) = \frac{1}{\sqrt{328}} \sqrt{\frac{\sum_{i=1}^{329} RRMS_i^2}{329}} . \tag{7}$$

and can be expressed as follows in terms of the $G_i$ values:

$$\frac{1}{\sqrt{328}} \cdot \frac{1}{\sqrt{329}} \cdot \sqrt{\sum_{i=1}^{328} iG_i^2 + \sum_{i=329}^{656} (657-i)G_i^2} . \tag{8}$$

The terms in equation (8) can be expanded and expressed by multiple summations over consecutive groups of time intervals to define certain quantities and thereby simplify the expression for implementation in firmware and hardware:

$$RMS(RRMS) = \frac{1}{\sqrt{328}} \cdot \frac{1}{\sqrt{329}} \cdot \left( \sum_{i=1}^{8} iBC^2 + \sum_{i=9}^{320} iG_i^2 + \sum_{i=321}^{328} iSF^2 + \sum_{i=329}^{336} (657-i)SF^2 + \sum_{i=337}^{648} (657-i)G_i^2 + \sum_{i=649}^{656} (657-i)BC^2 \right)^{1/2} . \tag{9}$$

The $G_i$ values in equation (9) represent the 312 time intervals. The following terms in equation (9) can be expressed as:

$$K_1 = \sum_{i=1}^{8} iBC^2 + \sum_{i=649}^{656} (657-i)BC^2 = 72BC^2 \tag{10}$$

$$\sum_{i=321}^{328} iSF^2 + \sum_{i=329}^{336} (657-i)SF^2 = \left( \sum_{i=321}^{328} i + \sum_{i=329}^{336} (657-i) \right) SF^2 = K_2 SF^2 = 5192\, SF^2 \tag{11}$$

$$K_3 = \frac{1}{\sqrt{328}} \frac{1}{\sqrt{329}} = 0.0030441. \tag{12}$$

Substituting in equation (9) the quantities expressed in equations (10), (11), and (12) simplifies equation (9) to read:

$$RMS(RRMS) = K_3\sqrt{K_1 + K_2SF^2 + \sum_{i=9}^{320} iG_i^2 + \sum_{i=337}^{648}(657-i)G_i^2} \quad . \tag{13}$$

Because SF represents the splice correction factor to be inserted during frame subintervals C and D, equation (13) is solved for SF:

$$SF = \sqrt{\frac{\left(\frac{F_{bar}}{K_3}\right)^2 - K_1 - \left(\sum_{i=9}^{320} iG_i^2 + \sum_{i=337}^{648}(657-i)G_i^2\right)}{K_2}} \quad . \tag{14}$$

Because $F_{bar}$ equals a constant, the first term in the numerator of equation (14) can be expressed as a constant term $$K_4 = \left(\frac{F_{bar}}{K_3}\right)^2 - K_1,$$

and equation (14) can be rewritten as $$SF = \sqrt{\frac{K_4 - \left(\sum_{i=9}^{320} iG_i^2 + \sum_{i=337}^{648}(657-i)G_i^2\right)}{K_2}} \quad . \tag{15}$$

For $F_{bar}$=18.798 (the computation of which is set out with reference to equation (19) below), $$K_4 = \left(\frac{18.798}{0.0030441}\right)^2 - 25{,}442 = 38{,}106.860. \tag{16}$$

Thus, the final expression for SF, which is implemented in the system shown in the block diagram of FIG. 9, is:

$$SF = \sqrt{\frac{38{,}106{,}860 - \left(\sum_{i=9}^{320} iG_i^2 + \sum_{i=337}^{648}(657-i)G_i^2\right)}{5{,}192}} \quad . \tag{17}$$

After an SF is computed for a pair of next adjacent frames, there is no carry forward of the SF for a succeeding pair of next adjacent frames, even though one of them is common to both pairs of frames. The BC values positioned at subframe intervals A and F of the succeeding pair of next adjacent frames are, therefore, independent of the just computed SF. This is so because, in the absence of a splice at the transition between the next adjacent pair of frames, a carry forward of a SF would induce a splice when there otherwise is none. Thus, once a splice is corrected with an SF, the correction technique assumes the splice is no longer there, i.e., there is no optical aberration, as the SF calculations proceed for succeeding pairs of frames.

With reference to FIGS. 9 and 10, a splice factor computation circuit 200 computes in accordance with the following process for each column signal the SF that corrects for SPLICE 1, which occurs between frames 1 and 2. The $G_i$ values for frames 1 and 2 are delivered on a column sequential basis serially for each time interval to the input 202 of a $G_i$ frame delay buffer register 204 and to the input 206 of a magnitude converter 208. (For simplicity in FIGS. 9 and 10, the $G_i$ values again refer to the score and PHM contributions.) Buffer register 204 delays the application of the $G_i$ to their respective column signal electrodes until the SF has been computed, and magnitude converter 208 converts the $G_i$, which are presented in unsigned magnitude format, to a format that represents the polarities of the $G_i$. The reformatted $G_i$ appearing at the output 210 of magnitude converter 208 are applied to the input of each of an even splice factor accumulator 212$_e$ and an odd splice factor accumulator 212$_o$. Splice factor accumulators 212$_e$ and 212$_o$ are of the same design and include computation modules that perform the summation processes and square root operation set out in equation (17) to compute the SF.

The computation modules of splice factor accumulators 212$_e$ and 212$_o$ are of the same design; therefore, for sake of simplicity, the discussion below omits reference to the subscripts "e" and "o". A multiplication module 220 receives and squares each $G_i$ appearing at output 210 of magnitude converter 208. The $G_i^2$ are multiplied by an integer "I", which takes on the values I=i for i=1 to 328 and I=(657-i) for i=329 to 648. Each resulting $I.G_i^2$ product is applied to the "A" input of a summer 222, whose output is applied to a memory 224. Memory 224 stores a running sum corresponding to the $G_i$ and I value appearing at the inputs of the multiplication module 220 because all column products are computed for a given I value. More specifically, because the $G_i$ appear at the input of multiplication module 220 in column sequence, 640 $G_i$ (for a 640 column display) are squared and summed as each I value is held constant. In other words, each I value represents a time during which 640 $G_i$ are squared and summed with their corresponding partial sums resulting from the previous I values in the sequence. Because no single column is summed completely at a given time, memory 224 stores the partial sums of products for each of the 640 columns as the I values are presented in sequence.

Thus, the output of memory 224 represents the value representing the quantity $$\sum_{i=9}^{320} iG_i^2 + \sum_{i=337}^{648}(657-i)G_i^2 \tag{18}$$

of equation (17). A square root look-up table (LUT) 226 receives at its address input the output of memory 224. LUT 226 stores SF values that correspond to the quantities expressed by equation (18). Each memory site of LUT 226 provides, therefore, a SF value that represents the square root of a quantity computed by taking the difference of 38,106,860 and the number applied to the address inputs and dividing the difference by 5,192. Thus, the output of LUT 226 is the SF value of equation (17).

A data selector 228 functioning as a 3-position switch selectively presents to its output 230 the delayed sequence of $G_i$ appearing at the output of buffer register 204, the SF computed by splice factor accumulator 212$_e$, or the SF computed by splice factor accumulator 212$_o$. The interplay of splice factor accumulators 212$_e$ and 212$_o$ and timing of the operation of data selector 228 to provide a sequence of SF corresponding to the delayed sequence of $G_i$ are explained with particular reference to FIG. 10 for the calculation of the SF for SPLICE 1 of a single column, shown in FIG. 8.

FIG. 10A shows the grouping of incoming image data $G_i$ arranged in a sequence of alternative image frames denominated "even" and "odd". The space separating adjacent image frames represents the 16 splice correction time intervals. Successive pairs of "even" and "odd" image frames carry a common subscript (e.g., n−1, n, n+1). FIGS. 10F and 10G show that the "even"/"odd" designation and subscripts indicate the sequence of SF values computed in the separate splice factor accumulators 212$_e$ and 212$_o$. FIG. 10B shows the frame splices appearing between adjacent sets of image data $G_i$, each frame being identified with the "even"/"odd" designation and subscript of the just completed frame. FIGS.

10C and 10D) represent the stepwise (depicted as linear for clarity) increase or decrease of the values of I applied to, respectively, splice factor accumulator $212_e$ ("even I") and splice factor accumulator $212_o$ ("odd I"). The 312 values of I ranging between 9 and 320 correspond to the 312 time intervals (e.g., subframe intervals B and E) of the score and PHM contributions. The zero slope portion appearing at the transition between increasing or decreasing values of I correspond to the 16 time intervals used for splice and base correction (e.g., subframe intervals A, C, D, and F) at the end and beginning of adjacent frames.

Computation circuit 200 includes the two splice factor accumulators $212_e$ and $212_o$ because the processing of the running sums of the preferred implementation of the splice correction algorithm entails the use of $G_i$ values of each image frame two times in calculating the SF values.

For example, $G_i$ values of frame 2 are used to compute the SF value for the splice occurring between frame 1 and frame 2 and the SF value for the splice occurring between frame 2 and frame 3. The $G_i$ values for frame 2 used in calculating the SF value for the splice at the transition between frame 1 and frame 2 correspond to the summation for I=(657-i)=320→9 in equation (17), and $G_i$ values for frame 1 used in calculating the SF for the splice at the transition between frame 2 and frame 3 correspond to the summation for I=i=9→320 in equation (17). FIGS. 10A, 10C, and 10F show the temporal correspondence among the $G_i$ values, the even I values, and even SF value for the even splice (FIG. 10B); and FIGS. 10A, 10D, and 10G show the temporal correspondence among the $G_i$ values, the odd I values, and odd SF value for the odd splice (FIG. 10B). Data selector 228 selects, therefore, the $G_i$ and SF values in the time sequence shown in (FIG. 10E, 10F, and 10G).

Because it is to be inserted during the 16 time intervals at the frame transition (e.g., the SF value for SPLICE 1 occurring between frames 1 and 2) where the splice occurred, the SF value is inserted in the delayed $G_i$ stream (FIG. 10E) at the output of frame delay buffer register 204 during the 16 time intervals at the transition between the two frames (e.g., frames 1 and 2) where the splice occurred.

Splice factor computation circuit 200 of FIG. 9 carries out the calculation of the SF values for all of the columns in accordance with the procedure described above with reference to FIG. 10 for one column.

The value of $F_{bar}$ is computed from the equation:

$$F_{bar}=\sqrt{\frac{\sqrt{N}}{2(\sqrt{N}-1)}}\,, \tag{19}$$

in which N is the total number of rows selected during a frame period. Equation (19) is expressed for row signal amplitudes of ±1 unit values; therefore, for N=240 rows, $F_{bar}$=0.7308. To scale the $F_{bar}$ value to the binary domain, one computes the following scale factor:

$$\frac{\text{maximum binary value}}{\text{maximum column voltage in } \pm 1 \text{ domain}}\,.$$

For a MLAA-type system addressing seven lines at a time, the maximum binary value equals 52.5 and the maximum column voltage in the ±1 domain equals 2.04. Applying the scale factor to $F_{bar}$=0.7308, $$F_{bar}=0.7308\left(\frac{52.5}{2.04}\right)=18.798.$$

In an alternative implementation of the first embodiment shown in FIG. 5, the RMS(RRMS) can be computed on the fly without having to compute the individual running rms values $RRMS_i$. This is so because the expression for the RMS(RRMS) can be simplified to:

$$RMS(RRMS)=\frac{1}{\sqrt{328}}\sqrt{\sum_{i=1}^{329}RRMS_i^2}=\frac{1}{\sqrt{328}}\cdot\frac{1}{\sqrt{329}}\sqrt{\sum_{i=1}^{328}iG_i^2+\sum_{i=329}^{656}(657-i)G_i^2}\,. \tag{20}$$

The value for RMS(RRMS) and hence the correction factor can be determined from the coefficients of a digital filter, which would substitute for modules 112, 114, and 118 in FIG. 5. The $G_i^2$ coefficients can be expressed as:

$$\left.\frac{i}{328\times 329}\right|_{i=1}^{328}\text{ and }\left.\frac{(656-i)}{328\times 329}\right|_{i=329}^{656}\,. \tag{21}$$

The expression (21) above indicates that the $G_i^2$ coefficients for all of the columns can be loaded into the digital filter during a single clock cycle; therefore, the correction factor can be provided on the fly.

It will be obvious to those having skill in the art that many changes may be made to the details of the above-described preferred embodiments of the present invention without departing from the underlying principles thereof. As a first example, this technique may be carried out in displays that are not implemented with a gray scale capability, i.e., there are no PHM values. As a second example, it could be advantageous to distribute the SF time intervals throughout a frame period, instead of grouping them at the frame boundary. As a third example, the SF could be implemented by directly scaling the pixel voltage as a function of the splice by an amount that minimizes the dynamic crosstalk effect. The scope of the present invention should, therefore, be determined only by the following claims.

We claim:

1. In an rms-responding display, the display including overlapping first and second electrodes positioned on opposite sides of an rms-responding material to define an array of pixels that display arbitrary information patterns corresponding to pixel input data; the display receiving on the first electrodes a set of first signals, multiple ones of the first signals in the set each causing multiple selections of its corresponding first electrode during a frame that is divided into time intervals, the multiple selections taking place during different ones of the time intervals, and the time between corresponding time intervals of successive frames defining the duration of a frame period for the set of first signals; and the display receiving on the second electrodes second signals having during the frame period amplitudes with more than one magnitude determined in part by pixel input data of pixels defined by the corresponding electrodes, a method of determining the presence of dynamic crosstalk in the display of moving information patterns, comprising:

determining from the amplitude of each of the second signals produced for application to its corresponding second electrode a quantity indicative of a transient optical response of the display to a change in information provided for display by the pixels defined on their corresponding second electrode during successive frame periods of the set of first signals; and producing from the quantity a detection signal that represents the intensity of the transient optical response of the display.

2. The method of claim 1 in which the successive frame periods include first and second successive frame periods each having multiple time intervals, in which the quantity includes for the first and second frame periods a set of rms voltage values produced for application to the second electrode during the time intervals, and in which the detection signal indicates the magnitude of a transitional rms voltage deviation computed from the set of rms voltages determined for the first and second frame periods.

3. The method of claim 2 in which the determination of the magnitude of the transitional rms voltage deviation includes:

defining a measurement time window;

determining running rms voltages corresponding to each overlap of the time window in different proportions of the time intervals of the first and second frame periods;

calculating an average value corresponding to the determined running rms voltages; and computing from the average value the magnitude of the transitional rms voltage deviation.

4. The method of claim 3 in which the measurement time window and the first and second frame periods are of the same duration, the first and second frame periods are separated by a transition, and the detecting of a transitional rms voltage deviation includes sliding the time window across the transition from the first frame period to the second frame period to calculate the average value.

5. The method of claim 1 in which the successive frame periods include first and second successive frame periods each having multiple time intervals and in which the determining of the quantity indicative of a transient optical response includes:

determining for the time intervals of the first and second frame periods rms voltage values produced for application to a second electrode;

defining a measurement time window having a duration;

determining an average rms voltage corresponding to a particular proportion of overlap of the time window of the time intervals of the first and second time periods; and optimizing the duration of the time window and the proportion of overlap to determine a transitional rms voltage deviation having a magnitude and direction corresponding to the transient optical response.

6. The method of claim 1 in which the first and second frames are separated by a transition and in which the detecting of the transient optical response of the display includes optically detecting for each of the second electrodes a brightness transition corresponding to the transition between the first and second frame periods.

7. In an rms-responding display, the display including overlapping first and second electrodes positioned on opposite sides of an rms-responding material to define an array of pixels that display arbitrary information patterns corresponding to pixel input data; the display receiving on the first electrodes a set of first signals, multiple ones of the first signals in the set each causing multiple selections of its corresponding first electrode during a frame that is divided into time intervals, the multiple selections taking place during different ones of the time intervals, and the time between corresponding time intervals of successive frames defining the duration of a frame period for the set of first signals; and the display receiving on the second electrodes second signals having during the frame period amplitudes with more than one magnitude determined in part by pixel input data of pixels defined by the corresponding electrodes, a method of determining the presence of dynamic crosstalk in the display of moving information patterns, comprising:

determining from the amplitude of each of the second signals produced for application to its corresponding second electrode a quantity indicative of a transient optical response of the display to a change in information provided for display by the pixels defined on their corresponding second electrode during successive frame periods of the set of first signals; and deriving from the quantity a correction factor for application to the display elements to suppress and thereby render less noticeable the transient optical response of the display.

8. The method of claim 7 in which the successive frame periods include first and second successive frame periods each having multiple time intervals and in which the deriving from the quantity a correction factor includes:

defining a measurement time window;

determining for the time intervals of the first and second frame periods rms voltage values produced for application to a second electrode, the determining of the rms voltage values corresponding to each overlap of the time window in different proportions of the time intervals of the first and second frame periods;

deriving from the determined rms voltage values an error signal that is indicative of the amplitude of a transitional rms voltage deviation corresponding to the transient optical response; and applying the error signal as a gain factor to the second signal applied to the second electrode.

9. The method of claim 8 in which the measurement time window and the first and second frame periods are of the same duration, the first and second frame periods are separated by a transition, and the determining of the rms voltages includes sliding the time window across the transition from the first frame period to the second frame period to calculate an average rms voltage from which the transitional rms voltage deviation can be determined.

10. The method of claim 7 in which the second signal applied to its corresponding second electrode has values and in which the successive frame periods include first and second consecutive frame periods separated by a transition, each of the first and second frame periods having multiple time intervals including information display time intervals corresponding to the values of the second signal and transient response correction time intervals, and the correction factor for a transient optical response appearing at the transition being applied to the display elements during the transient response correction time intervals.

11. The method of claim 10 in which the transient response correction time intervals are provided at the end of the first frame period and at the beginning of the second frame period and together provide a substantially zero DC voltage contribution.

12. The method of claim 7 in which the correction factor is applied to the second electrode on which the display elements are defined.

13. A system for identifying and correcting for a display pattern splice on a column electrode in a passive matrix rms-responding display, comprising:

storage sites for holding column signal values for time intervals associated with first and second frames separated by a splice transition;

a computing device for computing an error parameter that corresponds to a sum of different sets of sums each of a predetermined number of quantities derived from a corresponding number of column signal values, a majority of the sets of sums including quantities corresponding to column signal values for time intervals in the first and second frames;

a splice error-determining processor for determining from the error parameter the presence of a display pattern splice error, the splice error-determining processor determining a correction factor that modifies the rms value of column signal values for the time intervals associated with the first and second image frames separated by the splice transition; and a column signal corrector receiving from the storage sites the column signal values and the correction factor to provide display pattern splice-corrected column signals to the display.

14. The system of claim 13 in which the computing device comprises a first rms calculator that computes each set of sums by determining the rms value of the column signal values in each set.

15. The system of claim 13 in which the splice error-determining processor comprises a second rms calculator that computes the correction factor by determining the rms value of the set of sums.

16. The system of claim 13 in which the number of sets of sums is about equal to the number of the time intervals in either of the first frame or the second frame.

17. The system of claim 13 in which the number of time intervals in the first and second frames is the same and defines a time window, and the sets of sums include an increasing number of quantities associated with time intervals in the second frame and a corresponding decreasing number of quantities associated with time intervals in the first frame so that the sets of sums represent a time window that is successively phase-displaced in an increasing amount of overlap of the second frame period.

18. The system of claim 13 in which the column signal values are applied to a corresponding column electrode of the display, each of the first and second frames has multiple time intervals including multiple information display time intervals corresponding to the column signal values and transient response time intervals, and the correction factor for a splice appearing at the splice transition is applied to the column electrode during the transient response correction time intervals.

19. The system of claim 18 in which the transient response correction time intervals are provided at the end of the first frame and at the beginning of the second frame and together provide a substantially zero DC voltage contribution.

* * * * *